US010417895B2

(12) United States Patent
Drouet et al.

(10) Patent No.: US 10,417,895 B2
(45) Date of Patent: Sep. 17, 2019

(54) METHOD AND DEVICE FOR IMPROVING MARITIME PLATFORM SAFETY

(71) Applicant: NAVAL GROUP, Paris (FR)

(72) Inventors: Céline Drouet, Nantes (FR); Xavier Dal Santo, Nantes (FR); Nicolas Cellier, Nantes (FR)

(73) Assignee: NAVAL GROUP, Paris (FR)

( * ) Notice: Subject to any disclaimer, the term of this patent is extended or adjusted under 35 U.S.C. 154(b) by 1 day.

(21) Appl. No.: 15/760,968

(22) PCT Filed: Sep. 16, 2016

(86) PCT No.: PCT/EP2016/072045
§ 371 (c)(1),
(2) Date: Mar. 16, 2018

(87) PCT Pub. No.: WO2017/046373
PCT Pub. Date: Mar. 23, 2017

(65) Prior Publication Data

US 2018/0268677 A1 Sep. 20, 2018

(30) Foreign Application Priority Data

Sep. 17, 2015 (FR) ..... 15 01928

(51) Int. Cl.
*G08B 21/10* (2006.01)
*G08B 25/00* (2006.01)
*B63J 99/00* (2009.01)

(52) U.S. Cl.
CPC ..... *G08B 21/10* (2013.01); *G08B 25/002* (2013.01); *G08B 25/009* (2013.01); *B63J 2099/006* (2013.01)

(58) Field of Classification Search
CPC .... G01C 13/004; G01C 13/90; G01C 13/002; G01C 13/58; B63B 17/0081; B63B 22/00;
(Continued)

(56) References Cited

U.S. PATENT DOCUMENTS 4,988,885 A * 1/1991 Lindstrom ..... G01C 13/004 250/239
6,064,924 A * 5/2000 Fleischmann ..... G01S 7/411 701/16
(Continued)

FOREIGN PATENT DOCUMENTS

| | | | |
|---|---|---|---|
| DE | 20 2005 001 062 | U1 | 7/2005 |
| EP | 2124205 | A1 | 11/2009 |
| WO | 2007/007728 | A1 | 1/2007 |

OTHER PUBLICATIONS

Fleischer et al., "An integration platform for heterogeneous sensor systems in GITEWS—Tsunami Service Bus", Natural Hazards and Earth System Sciences, 2010, pp. 1239-1252, vol. 10, XP055272046.
(Continued)

*Primary Examiner* — Hoi C Lau
(74) *Attorney, Agent, or Firm* — Young & Thompson

(57) ABSTRACT

Disclosed is a method and a device for improving the safety of a maritime platform, installed at sea or navigating at sea, including an observation of sea waves striking the maritime platform, an operation of the maritime platform being controlled via a control system. The method and device are suitable for: —acquiring elevation values of the surface of the sea at a plurality of points, making it possible to characterize at least one group of sea waves, a sea wave being likened to a wave defined by a period and an amplitude, —calculating at least one characteristic quantity of each group of waves, —comparing the calculated characteristic quantity to a hazard threshold, —if the comparison
(Continued)

indicates the hazard threshold is crossed, raising an alert intended for the control system.

12 Claims, 4 Drawing Sheets

(58) Field of Classification Search
CPC ..... G01S 19/17; G01S 15/58; G01S 7/411; H04W 4/90; H04W 4/22
See application file for complete search history.

(56) References Cited

U.S. PATENT DOCUMENTS 6,255,980 B1 * 7/2001 Matthews ..... G01S 13/90 342/22
8,423,487 B1 * 4/2013 Rubin ..... G01W 1/00 114/312
8,502,686 B2 * 8/2013 Annunziato ..... G08B 3/10 340/601
9,544,748 B2 * 1/2017 Ishikawa ..... H04W 4/90
2004/0024503 A1 * 2/2004 Swinbanks ..... B63B 17/0081 701/36
2005/0278094 A1 * 12/2005 Swinbanks ..... B63B 17/0081 701/37
2010/0174488 A1 * 7/2010 Mai ..... G01S 19/17 702/3
2010/0302908 A1 * 12/2010 Strong ..... G01S 15/58 367/90
2015/0185007 A1 * 7/2015 Deshetler Brinton ..... G01C 13/002 702/2
2016/0157073 A1 * 6/2016 Ishikawa ..... H04W 4/90 455/404.1
2016/0203696 A1 * 7/2016 Suzuki ..... G01C 13/002 702/2
2017/0058473 A1 * 3/2017 Anh ..... E02B 7/40
2017/0248721 A1 * 8/2017 Poole ..... G01V 1/36
2018/0238007 A1 * 8/2018 Anh ..... E02B 7/40
2018/0268677 A1 * 9/2018 Drouet ..... G08B 25/009

OTHER PUBLICATIONS

Wächter et al., "Development of tsunami early warning systems and future challenges", Natural Hazards and Earth System Sciences, 2012, pp. 1923-1935, vol. 12, XP055272044.
French Search Report, dated May 11, 2016, from corresponding FR application No. 1501928.
International Search Report, dated Jan. 2, 2017, from corresponding PCT application No. PCT/EP2016/072045.

* cited by examiner

METHOD AND DEVICE FOR IMPROVING MARITIME PLATFORM SAFETY

FIELD OF THE INVENTION

The present invention relates to a method for improving the safety of a maritime platform that is installed at sea or navigating at sea, wherein this involves observation of the sea waves striking the platform and a characterization of a level of danger of the sea waves with respect to maritime platform operation. It also relates to a device and an associated computer program.

The invention is intended for the field of maritime operations, and concerns various maritime platforms, fixed or mobile, for example wind turbines, vessels.

DESCRIPTION OF THE RELATED ART

Such maritime platforms are constantly struck by sea waves. In a known manner, successive sea waves of large amplitude may cause damage to equipment and harm to people, as well as jeopardizing the safety of maritime operations.

In particular, when the maritime platform is a vessel, the movement of this vessel under the effect of the sea waves is all the more important as the period of each sea wave is close to the period of the vessel's own movements.

There exist means of observation to determine the elevation of sea waves above sea level, which represents the zero altitude level.

However, in order to improve the safety of a maritime platform it is not only useful to observe sea waves, but also to analyze whether they are likely to put a maritime operation of the platform at risk, by considering one or more characteristic quantities of the sea waves (amplitude, period, energy, . . . ).

For example, such marine operations include landing, drone recovery, wind turbine control adaptation operations to secure its structure or navigation control of a vessel.

At present, deterministic sea wave modeling methods are known which require a thorough knowledge of the physical amplitude and phase parameters of the sea waves, and which require a great deal of programming power because of the complexity of the calculations to be performed.

BRIEF SUMMARY OF THE INVENTION

The object of the invention is to remedy at least some of the drawbacks of the known methods by proposing a method for improving maritime platform safety that is faster and requires reduced computing resources.

For this purpose, the invention proposes a method for improving the safety of a maritime platform that is installed at sea or navigating at sea, wherein it comprises observation of sea waves striking the maritime platform, wherein maritime platform operation is controlled by the intermediary of a control system.

The method comprises steps of:

- acquiring elevation values of the sea surface at a plurality of points, thus making it possible to characterize at least one wave group, wherein a sea wave is likened to a wave defined by a period and an amplitude,
- calculating at least one characteristic quantity of each wave group,
- comparing the calculated characteristic quantity with a hazard threshold,

- wherein, if the comparison indicates a crossing of the hazard threshold, raising of an alert for the control system.

Advantageously, the invention proposes wave group analysis, and an evaluation of the danger as a function of a characteristic quantity of a wave group, wherein the characteristic quantity is preferably chosen as a function of the operation of the marine platform.

The method according to the invention may also have one or more of the following characteristics, taken independently or in any technically acceptable combination.

The method further includes estimating a propagation time of the wave group to a position of the marine platform operation, while the raising of an alert indicates the propagation duration.

The duration of propagation of the wave group to reach the position of the operation of the maritime platform is calculated as a function of a calculated speed, wherein the calculated speed is a group speed or a speed calculated as a function of the selected characteristic quantity and corrected for possible propagation errors.

The characteristic quantity is selected according to the operation of the maritime platform.

The calculation of at least one characteristic quantity comprises acquisition of an observation matrix at a given time instant, wherein each element of the observation matrix is equal to an elevation value above a reference level of the sea surface, at a given observation point in a grid of an observation area.

The observation area is rectangular, wherein one of the sides of the observation area is collinear with a main direction of sea wave propagation.

The method involves applying a convolution mask to the observation matrix.

It involves a directional spectrum estimate of the sea waves characterizing the sea in the vicinity of the maritime platform, while the dimensions of the convolution mask are selected according to parameters of the directional spectrum.

It involves the calculation of a group-significant height matrix, wherein each element is associated with a given spatial index observation point, and has a value representative of the sea wave energy whose observation points are included in a spatial area defined by the convolution mask and centered on the observation point.

According to a second aspect, the invention relates to a device for improving the safety of a maritime platform that is installed at sea or navigating at sea, comprising observation of sea waves striking the maritime platform, wherein an operation of the maritime platform is controlled by the intermediary of a control system.

The device comprises modules adapted to:

- acquire elevation values of the sea surface at a plurality of points, making it possible to characterize at least one wave group, wherein a sea wave is likened to a wave defined by a period and an amplitude,
- calculate at least one characteristic quantity of each wave group,
- compare the calculated characteristic quantity with a hazard threshold, if the comparison indicates an exceeding of the hazard threshold, raising an alert intended for the control system.

According to a third aspect, the invention relates to a computer program product comprising code instructions which, when implemented by one or more programmable device calculation processors implement the method as briefly described above.

BRIEF DESCRIPTION OF THE DRAWINGS

Other characteristics and advantages of the invention will emerge from the description which is given below, by way of indication and in no way limitative, with reference to the appended figures, wherein.

DETAILED DESCRIPTION OF THE PREFERRED EMBODIMENTS

Figure 1:
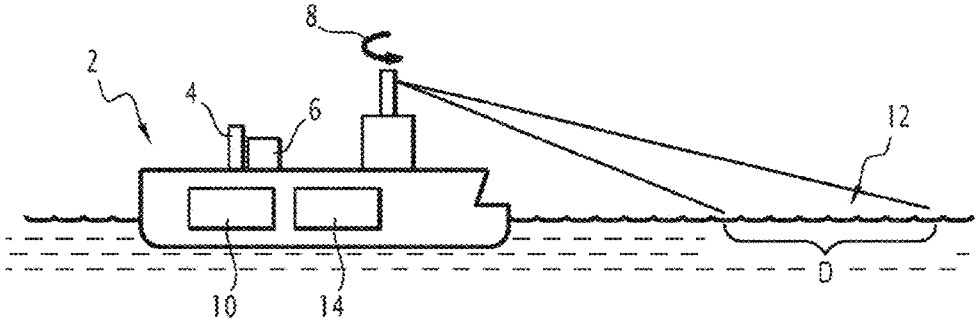
FIG. 1 shows schematically a vessel comprising a device implementing an embodiment of the invention.

FIG. 1 shows schematically a vessel 2, which is a marine platform navigating at sea.

This is a non-limitative example of a marine platform to which the invention applies. In particular, the invention applies to marine platforms installed at sea, for example a wind farm.

The vessel 2 is equipped with geolocation instruments 4 and an inertial unit 6 to calculate the position and the speed of movement at each moment.

The vessel is also equipped with a set of sensors 8, for example of the LIDAR or RADAR type, making it possible to analyze the surface of the sea 12 in an observation area D. The range of these sensors is at least equal to the notification period necessary for the implementation of the desired maritime operation.

In one embodiment, the observation area D has, for example, a rectangular perimeter located at a given distance from the vessel.

Alternatively, the observation area may have a perimeter in the form of a circular or oval ring, wherein the set of sensors 8 is able to rotate through 360°, making it possible to acquire several sets of data around the vessel 2.

The surface of the sea 12 is analyzed near the vessel 2 carrying the sensors 8, and a dangerous level of wave groups estimated.

The sensors are capable of analyzing the sea surface up to a given observation distance from the vessel 2, making it possible to calculate a corresponding notification period.

By way of a non-limitative example, an observation distance of half a nautical mile gives a warning of 30 to 60 seconds depending on the sea state encountered and the speed of advance of the maritime platform.

Groups of waves whose level of danger is higher than a predetermined hazard threshold are propagated towards one or more marine platforms including the vessel 2 to allow the operator to anticipate with a given notification period, and to adjust the completion of various maritime operations on these maritime platforms.

The vessel also comprises a programmable device 10, for example a computer, which receives data obtained by the sensors 8, as well as data from the geolocation instruments 4 and the inertial unit 6.

This programmable device 10 is part of, or is associated with, a control system 14 and provides information for maritime platform safety improvement according to the invention.

The control system, controlled remotely or by an operator, makes it possible to control various maritime operations on the maritime platform, for example landing on the vessel. In the case where the marine platform is a wind farm, the control system allows, for example, wind turbines to be oriented.

Figure 2:
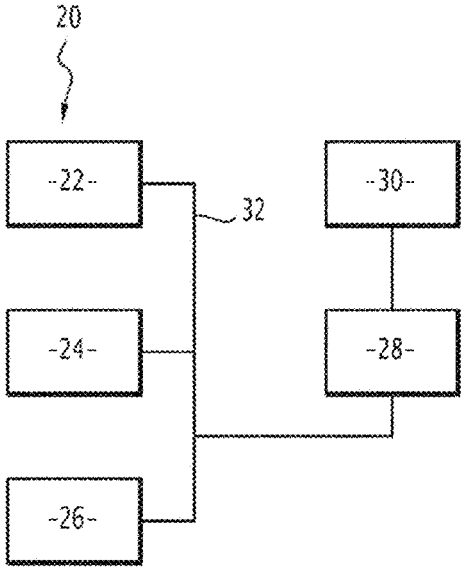
FIG. 2 shows a block diagram of the main blocks of a programmable device capable of implementing the invention.

FIG. 2 shows schematically the main functional blocks of a computer-type, workstation-type programmable device that is able to implement the method of the invention.

In one embodiment, the programmable device is a computer of a control system 14 of the vessel 2.

A programmable device 20 that is capable of implementing the method of the invention comprises a central processing unit 28, comprising one or more processors that are able to execute computer program instructions when the device 20 is powered up. In one embodiment, a multiprocessor CPU is used to perform parallel computations. The device 20 also comprises information storage means 30, for example registers that are capable of storing executable code instructions enabling the implementation of programs comprising code instructions that implement the methods according to the invention.

The device 20 comprises control means 24 for updating parameters and receiving commands from an operator. When the programmable device 20 is an onboard device, the control means 24 comprise a telecommunication device for receiving remote commands and parameter values.

Alternatively and optionally, the control means 24 may be means for inputting commands from an operator, for example via a keyboard.

The programmable device 20 comprises a screen 22 and additional pointing means 26, such as a mouse.

The various functional blocks of the device 20 described above are connected via a communication bus 32.

The sensors 8 are able to measure an elevation of the sea surface, with respect to a reference level, at a plurality of points distributed in the observation area, at successive time instants. The reference level is typically the sea level, i.e. zero altitude.

Figure 3:
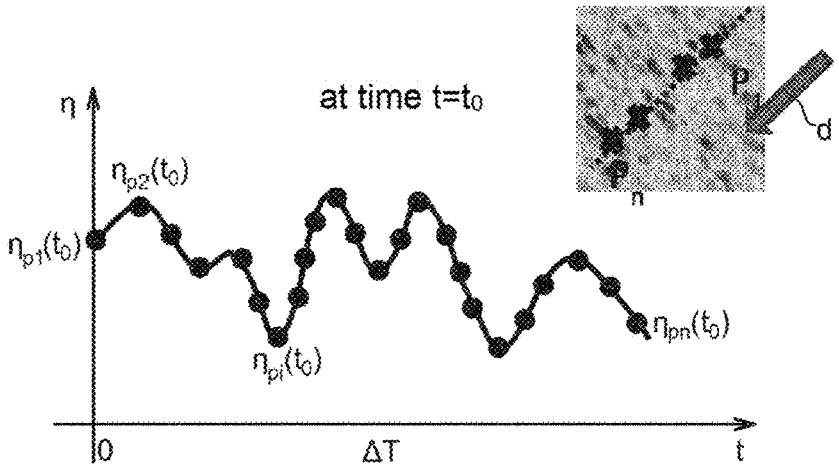
FIG. 3 shows a graph illustrating a signal that is representative of a sea wave.

The observation of the elevation of the sea surface at a plurality of observation points $P_1$ to $P_n$ at a given time instant $t_0$ makes it possible to reconstitute the temporal profile of a wave (defined by a period and an amplitude) that is representative of a sea wave, as illustrated in FIG. 3.

A graph shown in this figure comprises the time axis (t) on the abscissa and the elevation axis (η) on the ordinate with respect to the level of the sea.

For example, the time instants are expressed in seconds (s) with respect to a starting instant, corresponding to the observation of a first point $P_1$ of the sea surface, while the elevation (or amplitude) values are expressed in meters.

Knowing the speed of propagation of the sea waves, it is possible to place the observation at each point $P_i$ at time $t_0$ at a time instant t, according to the distance between the point $P_i$ and the point of origin of the observation $P_1$.

The points $P_1$ to $P_n$ in an observation direction d are shown in the upper right corner of FIG. 3.

Figure 4:
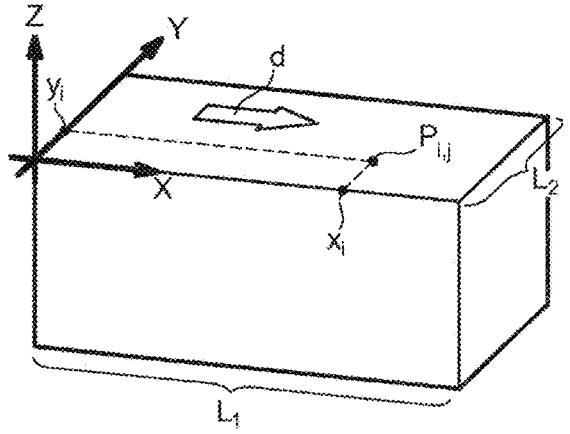
FIG. 4 shows schematically a sea wave observation area.

In one embodiment, the direction d is the propagation direction of the sea waves, while the observation points are distributed in an observation area D shown schematically in FIG. 4, with an associated three-dimensional spatial coordinate system (X, Y, Z).

In this example, the observation area and the associated coordinate system are preferably oriented so that one of the X or Y directions is collinear with the main sea wave propagation direction d. In this example, the area D has a rectangular surface in the plane (X, Y) with respective dimensions $L_1$ and $L_2$.

We observe a set of points $P_{i,j}$, of the area D, with $j) \in D, i \in [1, M_1]$, $j \in [1, M_2]$, wherein $M_1$ is the number of points observed in the direction X, while $M_2$ is the number of points observed in the direction Y.

In the exemplary embodiment, one side of the rectangular area D is collinear with the sea wave propagation direction d.

In one embodiment, the points are distributed on a regular grid on the surface of the area D.

Alternatively, the tiling of points need not be regular.

The coordinates of the points may be represented in a cartesian coordinate system or in polar coordinates.

Alternatively, the observation area may have another geometric shape (oval, circular, etc.).

The elevation $\eta(x_i, y_j, t)$ observed is the coordinate along the Z axis of the point of the area D, of the spatial coordinates $(x_i, y_j)$, at time t.

Figure 5:
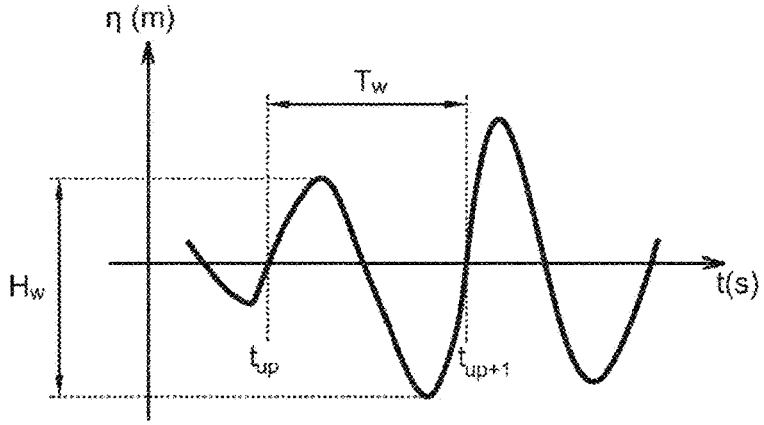
FIG. 5 shows schematically characteristic sea wave parameters.

As illustrated in FIG. 5, a sea wave is defined by a time signal, of the observed elevations, between two zero crossings at time instants $t_{up}$ and $t_{up+1}$. The characteristic parameters selected are its period $T_w$ and its amplitude $H_w$, which is the height between the lowest point (the hollow of the sea wave) and the highest point (the crest of the sea wave).

The sea waves are observed and are analyzed to detect groups of waves by using methods known to those skilled in the art. A wave group is defined, for example, by a succession of at least two sea waves having similar characteristics (large amplitude, period, . . . ).

Figure 6:
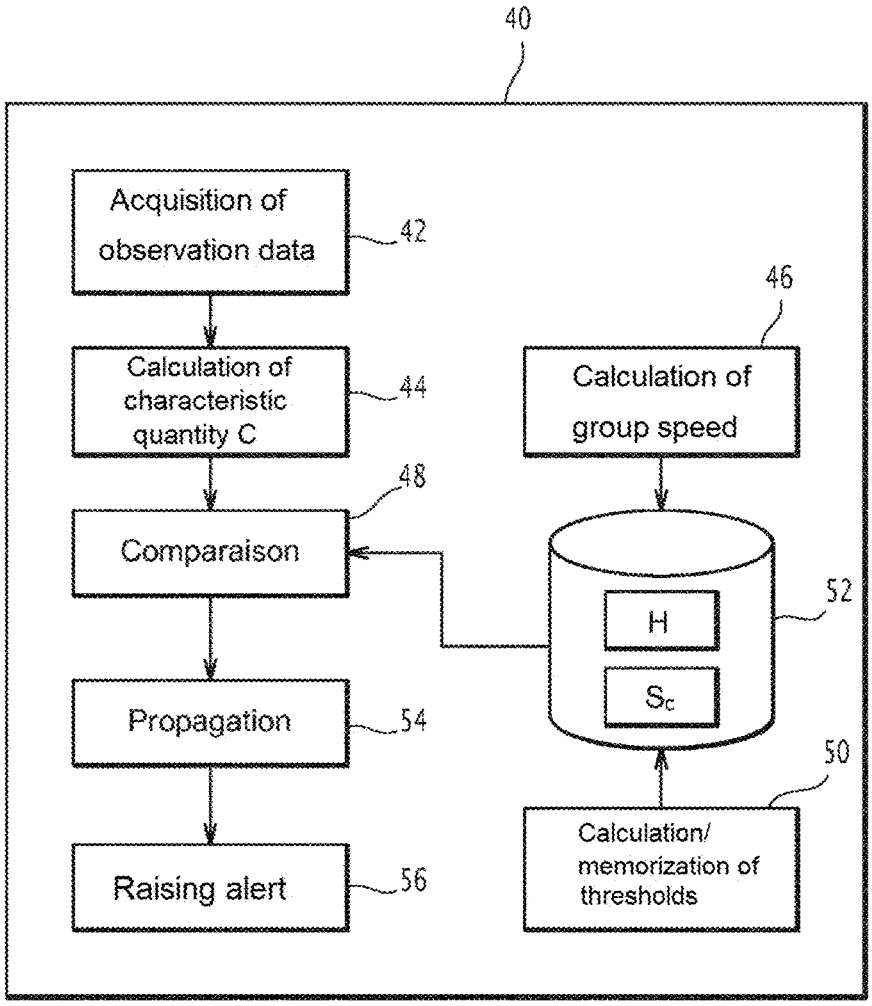
FIG. 6 shows a flowchart of the main functional blocks of a device for improving the safety of a marine platform according to one embodiment.

FIG. 6 shows a block diagram of the main modules implemented by a programmable device capable of implementing the invention.

The device 40 comprises a module 42 for acquiring observation data, in particular data relating to the elevation of the sea waves at each point observed.

It also comprises a module 44 for calculating one or more characteristic quantities of wave groups.

For example, a choice among several characteristic quantities C is envisaged as a function of the maritime operation to be monitored, or the movement that is characteristic of the vessel in question.

According to one embodiment, for certain types of operation, a characteristic quantity is energy, as detailed in the embodiment described hereinafter with reference to FIG. 7.

Alternatively, the characteristic quantity may be the period of the sea waves to prevent the occurrence of parametric rolling phenomena.

A module 46 implements the parameter calculations, for example the calculation of the velocity of the wave group observed, as well as the associated directional spectrum in a vicinity of the maritime platform.

The directional spectrum of the sea waves observed is characterized by parameters including in particular the peak period $T_p$, the significant height of the group $H_s$, the main direction of propagation d, the directional spread $\Delta_\beta$.

The values of the calculated parameters are stored in a memory unit 52.

It should be noted that several methods for estimating the directional spectrum of the sea waves observed are known to those skilled in the art (MLM for "Maximum Likelihood Method", maximum entropy, with methods for "spectral partitioning" to discretize several systems of sea states, . . . ).

The device comprises a comparison module 48 that is able to compare one or each of the characteristic quantities C calculated with a hazard threshold $S_c$ associated with this characteristic quantity, that was previously calculated and stored in the memory unit 52.

For example, the observation history data H is recorded, and a calculation module 50 is able to use these data to determine various hazard thresholds $S_c$.

Thus, in one embodiment, a set of parameter values associated with the envisaged operation, for example the amplitudes of movement of the vessel according to various degrees of freedom, are observed at times $t_i$ and these parameter values are memorized. Furthermore, the value of the characteristic quantity of a selected wave group, for example energy reaching the platform at time $t_i$, is calculated in relation to the envisaged maritime operation. Consequently, it is possible, automatically or semi-automatically with the assistance of an operator, to determine the hazard thresholds $S_c$ of a characteristic quantity as a function of the parameter values associated with the operation envisaged.

When the comparison module 48 indicates a crossing of the corresponding $S_c$ hazard threshold, a propagation module simulates the propagation of the observed wave group to the position of the operation performed by the maritime platform in question.

For example, the position of the operation is the spatial position of the maritime platform at a given time instant.

Alternatively, the propagation module simulates the propagation of the wave group observed up to the position of the operation carried out by the maritime platform in question, whatever the level of danger posed by the sea waves.

This simulation of propagation makes it possible to estimate the duration of propagation, and consequently to predict the arrival of a wave group detected as being dangerous for a given operation, with a given notification period, for example of the order of 30 seconds.

A module 56 makes it possible to raise an alert to warn the control system of the marine platform of the arrival of the wave group detected as being dangerous.

For example, in the case where the control system comprises man-machine interfaces and is controlled by an operator, visual or audible alerts are sent.

In one embodiment, the modules 42, 44, 46, 48, 50, 54 and 56 are software modules.

Figure 7:
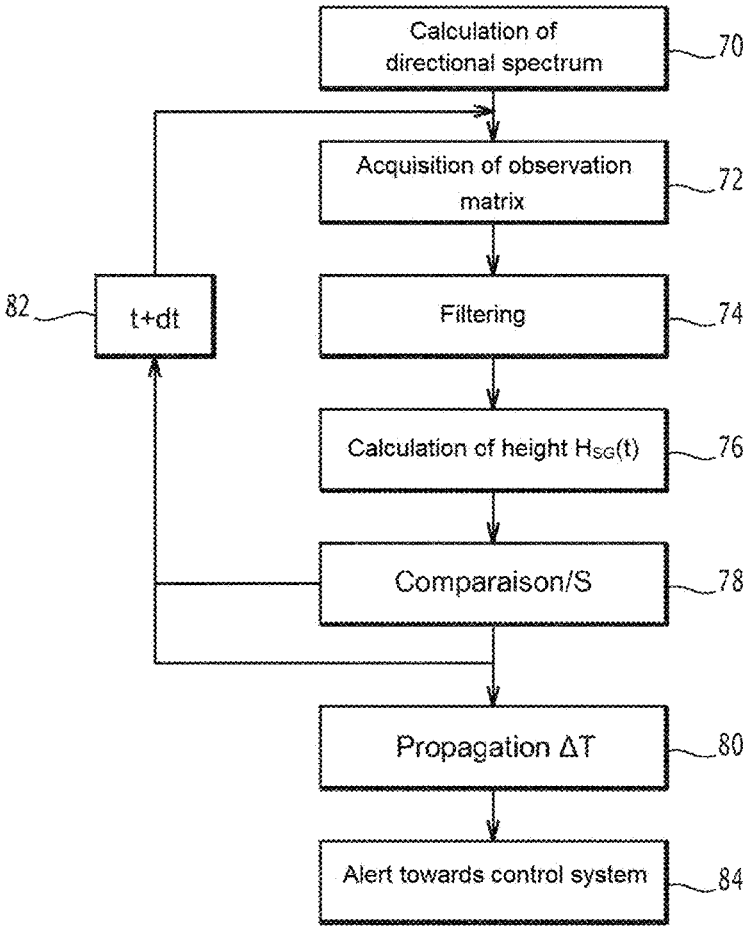
FIG. 7 shows a flowchart of the main steps implemented by a method for improving the safety of a maritime platform according to one embodiment.

FIG. 7 shows a flowchart of the main steps of a method for improving the safety of a maritime platform according to the invention, wherein the calculated characteristic quantity is representative of the energy of the packets of waves that are representative of the groups of observed sea waves.

During a first preliminary step 70, parameters are calculated and stored, in particular the parameters of the directional spectrum of the sea waves observed around the maritime platform and characterizing the state of the sea.

This step is followed by a step 72 of acquiring the observations of the elevation values $\eta(x_i, y_j, t)$ at each point $P_{i,j}$ of the area D, of the spatial coordinates $(x_i, y_j)$, at a current time instant t.

An observation matrix $O_{bt}$ of size $M_1 \times M_2$ is obtained. If we write $\eta(x_i, y_j, t) = \eta_{i,j}(t)$ as the index element (i,j) of the matrix, we have the following formula:

$$O_{bt} = \begin{bmatrix} \eta_{11}(t) & \eta_{12}(t) & \dots & \eta_{1M_1}(t) \\ & & & \\ \eta_{M_21}(t) & & & \eta_{M_2M_1} \end{bmatrix}$$

At the filtering step 74, a convolution mask P is applied at each point of the observation matrix $O_{bt}$.

In this embodiment, P is a rectangular mask all of whose coefficients are equal to 1.

In a more general way, this convolution mask may have different forms, for example a Gaussian, circular nucleus . . . .

The dimensions of this convolution mask are a function of the sea state encountered. For example, by choosing energy as the main characteristic, it is parameterized as a function of the sea wave peak period and the directional spread.

The filtering through applying the convolution mask P consists in calculating a filtered value for each point (i,j) of the observation matrix $O_{bt}$. The convolution mask may be directly applied to the observation matrix $O_{bt}$ or to a quantity derived from the observation matrix that is chosen according to the envisaged maritime operation, for example the sea wave period if one wants to study the parametric rolling phenomena.

The filtering step 74 is followed by a step 76 of calculating the significant group height $H_{SG,t}$ at each point (i,j), which is a significant quantity of the sea wave energy whose observation points are included in the area of the convolution mask P around the point $P_{i,j}$ associated with the point associated with the spatial index (i,j) of the observation matrix.

According to one variant, the filtering and the calculation of the significant height are carried out in a single step.

The calculated values of the significant group height are each compared, during a comparison step 78, with at a hazard threshold S, associated with the characteristic quantity $H_{SG,t}$, that was previously calculated and stored.

If the value of the hazard threshold S is exceeded by a value $H_{SG,t}$(i, j), step 78 is followed by a step 80 of propagating the matrix containing the values of the significant group height $H_{SG,t}$ to the maritime platform in question.

Alternatively, several hazard thresholds may be used, wherein each hazard threshold has an associated level of confidence.

Propagation step 80 implements the group velocity $$C_g = \frac{g}{4\pi} T_p$$

to propagate "dangerous sea waves".

Alternatively, another propagation speed is applied as a function of the selected criterion.

According to one alternative, the calculated propagation velocity is adjusted according to the propagation errors observed.

Step 78 is further followed by a step 82 of updating the observation time instant in question, wherein the current time instant t is set to the instant $t_s$=t+dt, where dt is the measurement sampling frequency, and step 82 is followed by the step 72 previously described.

Step 80 is followed by a step 84 alerting the control system of the maritime platform, for example in the form of a display on a graphical interface intended for an operator, when the calculated characteristic value exceeds one or more hazard thresholds.

Advantageously, the arrival of groups of waves having a level of danger compared to an operation performed on a maritime platform is thus provided, wherein a sufficient notification period is transmitted so that the operator of the control system may take corrective action. The safety of maritime operations is thus increased.

The invention claimed is:

1. A method for improving the safety of a maritime platform, installed at sea or navigating at sea, including an observation of sea waves striking the maritime platform, an operation of the maritime platform being controlled via a control system, the method comprising:

acquiring elevation values of the sea surface at a plurality of points to characterize at least one wave group, a sea wave being defined by a wave period and a wave amplitude, the wave group comprising a succession of two waves having similar wave periods or wave amplitudes;

calculating at least one characteristic quantity of each wave group;

comparing the calculated characteristic quantity with a hazard threshold; and when the comparison indicates the hazard threshold is crossed, raising an alert intended for the control system.

2. The method according to claim 1, further comprising estimating a propagation time of the wave group to a position of the operation of the maritime platform, wherein the alert raising indicates the propagation time.

3. The method according to claim 2, wherein the propagation time of the wave group to the position of the operation of the marine platform is calculated as a function of a calculated speed, the calculated speed being a speed of the wave group.

4. The method according to claim 1, wherein the characteristic quantity is selected according to the operation of the maritime platform.

5. The method according to claim 1, wherein the calculation of at least one characteristic quantity comprises acquiring a matrix of observations at a given time instant, each element of the matrix of observations being equal to an elevation value above a reference level of the sea surface at a given point of observation of a grid of an observation area.

6. The method according to claim 5, wherein the observation area is rectangular, one side of the observation area being collinear with a main direction of sea wave propagation.

7. The method according to claim 5, further comprising applying a convolution mask to the observation matrix.

8. The method according to claim 7, further comprising estimating the directional spectrum of the sea waves characterizing the sea in a vicinity of the maritime platform, wherein dimensions of the convolution mask are selected as a function of directional spectrum parameters.

9. The method according to claim 7, further comprising calculating a matrix of significant group height of which each element is associated with an observation point of given spatial index, and has a value representative of the sea wave energy whose observation points are included in a spatial area defined by the convolution mask and centered on said observation point.

10. A device for improving the safety of a maritime platform, installed at sea or navigating at sea, including an observation of sea waves striking the maritime platform, an operation of the maritime platform being controlled via a control system, the device comprising modules configured to, using one or more processors:

acquire elevation values of the sea surface at a plurality of points to characterize at least one wave group, wherein a sea wave being defined by a wave period and a wave amplitude, the wave group comprising a succession of two waves having similar wave periods or wave amplitudes;

calculate at least one characteristic quantity of each wave group;

compare the characteristic quantity calculated with a hazard threshold; and when the comparison indicates the hazard threshold is crossed, to raise an alert intended for the control system.

11. A non-transitory computer-readable medium embedded with a computer program comprising code instructions which, when implemented by one or more programmable device processors implement the method according claim 1.

12. The method according to claim 1, wherein the characteristic quantity is an energy of the wave group or a significant height of the wave group or a peak period of the wave group.

* * * * *